United States Patent [19]

Uhlemann et al.

[11] Patent Number: 4,931,174

[45] Date of Patent: Jun. 5, 1990

[54] ZIGZAG CLASSIFIER

[75] Inventors: Hans Uhlemann, Solingen; Heiko Herold, Neuss; Reinhard Boeck, Kaarst; Hans Daun, Leverkusen, all of Fed. Rep. of Germany

[73] Assignee: Bayer Aktiengesellschaft, Leverkusen, Fed. Rep. of Germany

[21] Appl. No.: 316,368

[22] Filed: Feb. 27, 1989

[30] Foreign Application Priority Data

Mar. 11, 1988 [DE] Fed. Rep. of Germany ..... 3808116

[51] Int. Cl.[5] ..... B03B 4/02

[52] U.S. Cl. ..... 209/139.1; 209/149; 209/154

[58] Field of Search ..... 209/151, 154, 139.1, 209/133, 138, 149, 145, 136, 137

[56] References Cited

U.S. PATENT DOCUMENTS

| | | | |
|---|---|---|---|
| 3,427,202 | 4/1969 | Kaiser | 209/138 X |
| 3,876,419 | 4/1975 | Brusov | 209/138 X |
| 3,925,198 | 12/1975 | Eckhoff et al. | 209/138 X |
| 3,929,628 | 12/1975 | Denevi et al. | 209/138 X |
| 4,235,707 | 11/1980 | Burke, Jr. | 209/145 |

FOREIGN PATENT DOCUMENTS

| | | | |
|---|---|---|---|
| 1135841 | 6/1960 | Fed. Rep. of Germany | 209/138 |
| 2641068 | 3/1978 | Fed. Rep. of Germany | 209/20 |
| 2804548 | 8/1979 | Fed. Rep. of Germany | 209/139.1 |
| 906633 | 2/1982 | U.S.S.R. | 209/138 |
| 1265002 | 10/1986 | U.S.S.R. | 209/154 |
| 1268212 | 11/1986 | U.S.S.R. | 209/154 |

*Primary Examiner*—Donald T. Hajec

*Attorney, Agent, or Firm*—Sprung, Horn, Kramer & Woods

[57] ABSTRACT

The zigzag classifier has a classifying space provided with air inlets which is subdivided into zigzag-shaped ducts, which are connected in parallel with respect to the flow, the lengths of which are greater than their widths. In this way a classifier package is formed with a plurality of small duct cross-sections. This design principle permits substantially lower overall heights for the same number of bends.

6 Claims, 2 Drawing Sheets

ZIGZAG CLASSIFIER

BACKGROUND OF THE INVENTION

The invention relates to a zigzag classifier with a classifying space and the associated air supply equipment.

A zigzag classifier for vertical tube air classifying of particulate products is known from the U.S. Pat. No. 1,861,248. This classifier has a plain, vertical, tube which is smooth on the inside and has a rectangular cross-section and which is inclined alternately to the right and to the left at the same angle to the vertical. The coarse fractions of the feed material slide downwards on whichever wall of the duct is underneath at the time. At the bends they have to cross through the classifying air flow coming from below. During each crossing a separation of fines takes place which in itself does not lead to a sharp classification. However, by multiple repetition a very sharp separation of the fractions can be achieved ultimately due to a multiplying effect.

The throughout of such a classifier increases with its cross-sectional area which, however, cannot be increased at will for reasons of uniform through-flow of classifying air, of fairly uniform distribution of material, of the thickness of the material layer and the like. However, if still more bends are provided to even out such irregularities, the dimensioning of the classifier and the control of the correct dimensions becomes problematical. This is particularly disadvantageous if the classifier is to be combined with other equipment such as, for example, with a fluidized bed spray granulator (see, for example, EP No. 163 836) to form a process engineering unit.

A pneumatic classifier, which is, for example, described in DE No. 1 507 686, was also developed for dedusting particulate material at high throughputs. In this classifier a strongly-fluidized fluidized bed is combined with a system of parallel zigzag ducts arranged above it. In this instance the feed bed travels through the fluidized bed in such a way that at the end coarse material emerges from the bed. The fine-material is checked for particle size in the zigzag ducts and, if it falls below a predetermined limiting particle, it is transferred by the classifying air into a collector. The coarse particles, on the other hand, fall back into the bed.

In addition, there are multi-duct zigzag classifiers on the market in which the material to be classified is supplied uniformly to the ducts by a distribution screw. The classifying air flows to the parallel ducts without metering. In order to avoid instability such classifiers should only be operated at a low solid loading.

SUMMARY OF THE INVENTION

The object of the invention is to improve the principle of zigzag separation so that a classifier can be constructed with the lowest possible overall height and a high sharpness of separation.

This object is achieved in accordance with the invention in that the classifying space is subdivided into zigzag-shaped ducts which are connected in parallel with respects to the flow, the lengths 1 of which are greater than double the widths b. The length 1 is preferably greater than double the width b.

This results in a classifier package with a plurality of small duct cross-sections. This design principle permits substantially lower overall heights for the same number of bends. In addition, however, it is also possible to reduce the number of bends for the same required separation result because the thickness of the material layer to be classified is so small that a significantly better classifying process takes place at the individual bends.

The division of the classifying space into a plurality of parallel ducts requires arrangements that ensure that all ducts are supplied with classifying air uniformly and independently of the current loading of the duct with solid material. For this purpose advantageous use is made of the principle of "sonic restrictors". "Sonic restrictors" are apertures through which, in their working range, the classifying air passes at sonic velocities. An amount of air therefore passes through them which, regardless of the pressure after the aperture, is determined only by the hole cross-section and the pressure before the aperture. If, in accordance with a preferred embodiment of the invention, a sonic restrictor is therefore allocated to each classifier duct, then for the same cross-section of the apertures all the ducts have the same air throughput. As the parallel classifier ducts are all supplied from the same common duct, the throughput of classifying air in all ducts can be varied uniformly by the pressure in the common duct.

The classifying air is injected into the ducts from below. It is advantageous if an air distribution tube with perforations on its upper side, which is inclined at $\alpha = 5°$ to 60° to the horizontal, is provided for even distribution of the classifying air over the duct cross-section. In this manner an increase is achieved in the flow velocity in the duct above the input position. The consequence of this for the particles to be discharged is that, due to a reducing contrary air flow in the direction of fall, their discharge is not hindered.

In practical operation of the new zigzag classifier it can happen that differing quantities of solid particles are fed to the individual ducts. However, differing solid loadings cause differing pressure distributions in the classifier ducts so that the air flows back from the more heavily loaded ducts and then finds it way through less heavily loaded adjacent ducts. This would lead to unstable behaviour of the classifying process as a whole and thus to a significant reduction of the sharpness of separation. To hinder such reverse flows it is advantageous if the cross-sections of the ducts are constricted below the feed points for the classifying air so that the coarse material particles of the required size can still fall straight out of the classifier duct without hindrance. The more particles that pass the constriction the more the cross-sectional construction is reinforced with respect to the flow by the falling particles. This leads directly to the required stabilization of the flow distribution.

In accordance with a special design of the proposal in accordance with the invention the constriction is given the form of a zigzag duct. It is known that zigzag ducts have a particularly high resistance coefficient which surpasses even those of labyrinth seals.

In the zigzag classifier in accordance with the invention a control device must be provided at the lower end where all the parallel classifier ducts discharge into a common space which maintains such a pressure in this space that no classifying air flows downwards out of the ducts but that also, on the other hand, no air is drawn from the surroundings by the ducts. This is achieved by an appropriate control system for the extraction system for the exhaust classifying air.

An exemplary embodiment of the invention is explained in greater detail below with the air of the drawings, in which

DETAILED DESCRIPTION OF THE INVENTION

Figure 1:
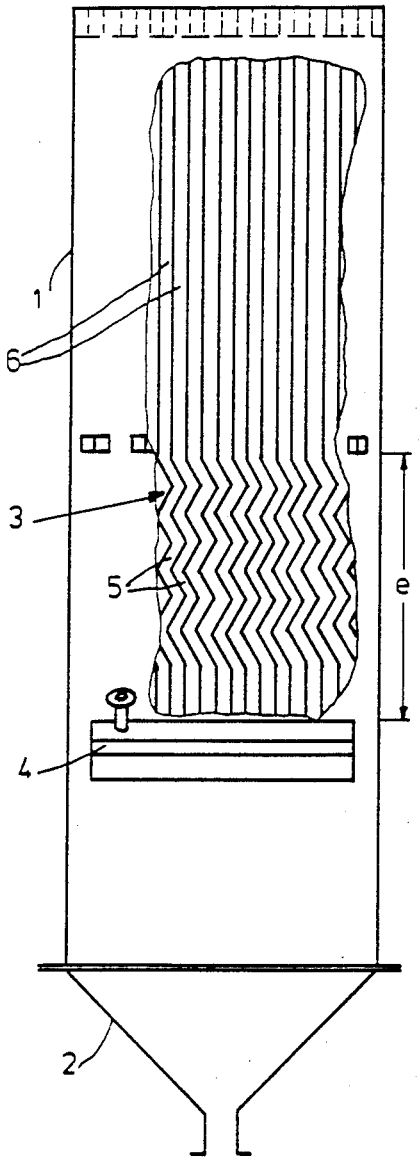
FIG. 1 shows an elevation of the multi-duct zigzag classifier.

The zigzag classifier shown diagrammatically in FIG. 1 consists of a casing 1 with a collecting space 2 for the discharged material of the required particle size, the zigzag classifier package and the air distribution duct 4 for the supply of classifying air. The zigzag classifier package consists of a plurality of vertically positioned, zigzag-shaped ducts 5 connected in parallel with respect to the flow with return shafts 6 seated on them. If necessary, the undersized material is thrown back into a material bed by the return shafts 6. They can have flat or zigzag-shaped duct walls.

Figure 2:
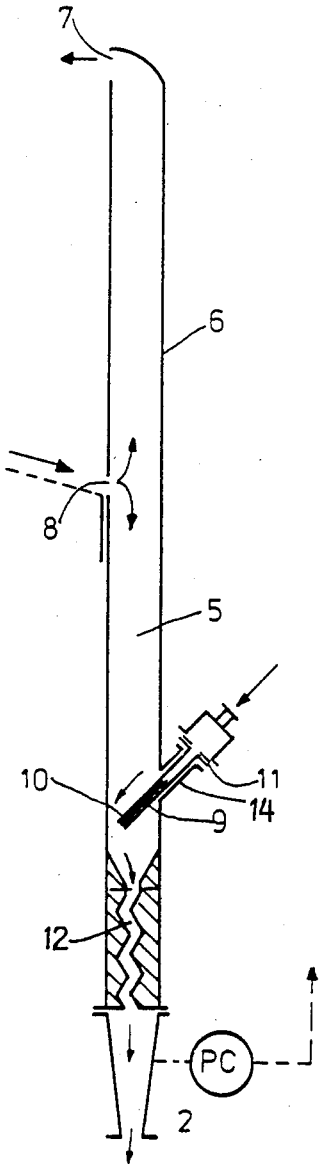
FIG. 2 shows a side view.

For this purpose there is an opening 7 (see FIG. 2) at the upper end of the return shaft 6. The material to be classified is fed to the upper end of the classifier ducts via the opening 8. At their lower end the ducts 5, as described in greater detail below, are connected to the air distribution duct 4 for the supply of classifying air. As can be seen from FIG. 2, each duct 5 is fitted with an air distribution tube 9 which is inclined, for example, at an angle $\alpha=45°$ to the horizontal and has perforations 10 in its surface so that the air emerges uniformly. The classifying air is supplied to the air distribution tube via an aperture or restrictor (sonic restrictor) through which the air flows at sonic velocity (see also the description for FIG. 3). Zigzag-shaped constrictions (labyrinths) 12 are positioned below the air distribution tubes 9 and their diameters are only slightly larger than the diameter of the classifier material to be discharged (required particles diameter). The coarse material particles can therefore still fall straight out of the classifier duct 5 without hindrance. The labyrinth 12 serves ultimately to improve the sharpness of separation if it is necessary to allow for differing solid loadings in the classifier ducts 5 resulting in differing pressure distributions. The constrictions 12 counteract flow instabilities which are produced by such differing pressure distributions.

Figure 3:
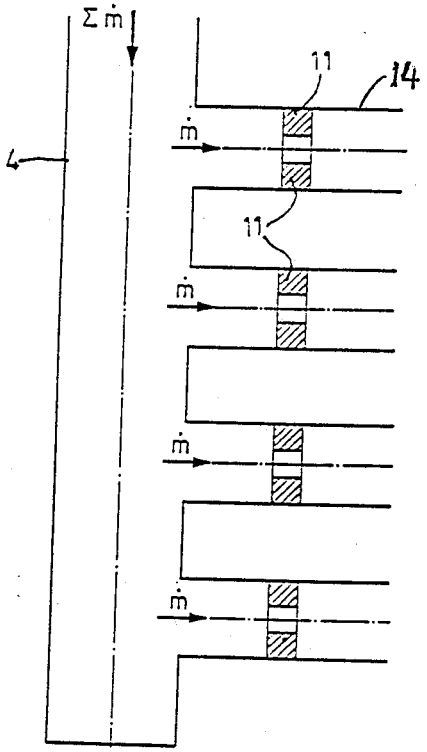
FIG. 3 shows the air supply to the classifier ducts.

The air supply to the air distribution tubes 9 can be seen from FIG. 3. The air flows for the ducts 5 branch off in parallel from the air distribution duct 4. The sonic restrictors 11 positioned in the individual inlets 14 to the air distribution tubes 9 have the effect that, regardless of the pressure after the sonic restrictor, a quantity of air flows into each air distribution tube 9 which is determined only by the cross-section and the pressure before the sonic restrictor. Thus, for the same cross-section of the sonic restrictor the air throughput is the same for all classifier ducts.

In order to vary the throughout of the classifying air in all ducts 5 uniformly it is thus only necessary to make an appropriate alteration to the pressure in the air distribution duct 4.

In order to ensure that air flows neither in nor out of the ducts through the collecting space 2 below the cross-sectional constriction 12, the extraction system for the exhaust classifying air is provided with a control device which ensures that there is atmospheric pressure in the collecting space 2. The classified material is extracted from the collecting space 2 through a cellular wheel sluice (not shown).

We claim:

1. An apparatus for classifying particulate material, comprising:
   (a) a plurality of vertically disposed zig-zag shaped channels, each having a uniform cross-section along the entire length thereof;
   (b) means forming a common collecting classifier space connected to all of the zig-zag channels at a bottom end thereof;
   (c) a plurality of air inlet means, each disposed above the common collecting classifier space at a lower end of the zig-zag channels for providing air to each individual channel; and
   (d) common air supply means connecting the channels in parallel and including a duct in communication with all of the air inlet means for providing each of the channels with the same air flow.

2. An apparatus according to claim 1, wherein each air inlet means comprises a restrictor through which air passes at sonic speed.

3. An apparatus according to claim 2, wherein each air inlet means further comprises a distribution tube having perforations on an upper side and wherein the distribution tube is included in the direction of the tube at 5° to 60° with respect to the horizontal plane.

4. An apparatus according to claim 3, further comprising a constriction between the lower end of each zigzag channel and the common collecting classifier space.

5. An apparatus according to claim 4, wherein the constriction is zigzag-shaped.

6. An apparatus according to claim 5, further comprising a pressure control device connected to the common collecting classifier space for maintaining a pressure at the lower end of the zigzag channels to prevent air from escaping the apparatus and being drawn in from outside.

* * * * *